US006557956B2

(12) United States Patent
Hightower

(10) Patent No.: US 6,557,956 B2
(45) Date of Patent: May 6, 2003

(54) CABINETS WITH FALSE FRONTS AND ASSOCIATED FALSE FRONT CONNECTORS FOR ENGAGING MULTIPLE SIDEWALLS

(76) Inventor: Robert C. Hightower, 1136 Skeet Club Rd., High Point, NC (US) 27265

( * ) Notice: Subject to any disclaimer, the term of this patent is extended or adjusted under 35 U.S.C. 154(b) by 0 days.

(21) Appl. No.: 09/766,220

(22) Filed: Jan. 19, 2001

(65) Prior Publication Data

US 2002/0096978 A1 Jul. 25, 2002

(51) Int. Cl.[7] ..... A47B 17/04

(52) U.S. Cl. ..... 312/204; 312/292; 312/293.3; 24/297; 403/408.1

(58) Field of Search ..... 403/329, 326, 403/408.1, 327, 406.1, 287; 24/297, 290; 312/204, 140, 265.6, 257.1, 292, 293.1, 293.3, 334.46, 348.4, 348.1

(56) References Cited

U.S. PATENT DOCUMENTS 3,279,011 A * 10/1966 Flora ..... 24/297 X
4,153,314 A * 5/1979 Prater ..... 312/244 X
5,542,757 A * 8/1996 Chang ..... 312/293.3 X

OTHER PUBLICATIONS

Pictures of two piece prior art connector (admitted prior art).
Pictures of two piece prior art connector (admitted prior art).
Pictures of one piece prior art connector (admitted prior art).

* cited by examiner

*Primary Examiner*—John G. Weiss
*Assistant Examiner*—Michael J. Fisher

(57) ABSTRACT

Connectors for attaching a false front panel over an opening in an object comprise a body portion that is configured to abut and attach to a rear side of the false front panel, and first and second snap clips that extend from the body portion and which are configured to engage opposing walls that define the opening in the object. These connectors may further include a third snap clip that extends from the body portion and that is configured to engage a third of the walls that defines the opening. The body portion of the connectors may extend the full width of the opening to be covered to facilitate alignment of the connector on the rear side of the false front panel.

23 Claims, 12 Drawing Sheets

CABINETS WITH FALSE FRONTS AND ASSOCIATED FALSE FRONT CONNECTORS FOR ENGAGING MULTIPLE SIDEWALLS

FIELD OF THE INVENTION

The present invention relates to cabinets or other objects having false front connectors, and more particularly to false front cabinets/objects including connectors for connecting the false front over an opening.

BACKGROUND OF THE INVENTION

A variety of cabinets, furniture and other objects have openings which are covered by a false front panel. By way of example, cabinets in bathrooms often include a false front panel in front of the bathroom sink that appears to be the front of a drawer. Such a false front is usually employed to match or compliment the front panel of an adjacent drawer or drawers. The false front panel is often used to cover an opening in the face of the cabinet. Connectors are known in the art for connecting such a false front panel over the opening in the cabinet or other object.

In many applications, false front panels are designed to be releasably attached to the wall, cabinet, furniture face or other object to which they are attached. In these applications, the false front panel may be removed to provide access to items inside of the wall, cabinet or other object such as a sink. In these applications, permanent connectors such as adhesives, rivets or nails, or semi-permanent connectors such as screws, are typically inappropriate. However, various other types of false front connectors are available that may be used to releasably attach a false front panel over an opening in an object.

One known type of releasable false front connector 10 is depicted in FIG. 1A. As shown in FIG. 1A, the false front connector 10 comprises a two piece connector that includes a clip 20 and a post 40. The post 40 is cylindrical in shape, and has a top end 42 and a bottom end 44. The post 40 further includes an aperture 46 along its central axis which extends from the top end 42 to the bottom end 44. As is also shown in FIG. 1A, along the central axis 47 of aperture 46 a larger countersunk recess 48 is formed in the top end 42 of post 40. The diameter of the recess 48 is sufficiently large so as to receive the head of a screw or nail. The diameter of aperture 46, on the other hand, is smaller than the head of the screw or nail, but large enough to receive the shank end of the screw/nail. In this manner, a screw or nail may be inserted into the top end 42 of post 40 and through the bottom end 44 into an object, to connect the post 40 to the object.

The second piece of the false front connection device 10, namely the clip 20, has a thin, flat body portion 22 and a latch 30 that extends from the body portion 22. The body portion 22 further includes an aperture 24 that is configured to receive a screw (not shown in FIG. 1A). The diameter of the aperture 24 is smaller than the head of the screw, but large enough to receive the shank end of the screw. In this manner, the screw may be inserted through the aperture 24 into a false front panel to connect the clip 20 to the false front panel. In the false front connector 10 depicted in FIG. 1A, the aperture 24 is located in the center of the body portion 22, between the two arms 32, 34 of the latch 30.

The latch 30 comprises a pair of opposed arms 32, 34 and a base portion 36. The arms 32, 34 are configured to receive the post 40. The arms 32, 34 connect to the top part of base 36, and together the inside portion of arms 32, 34 and the top portion of base 36 form a partial cylinder having a diameter slightly larger than the diameter of the post 40. The distal ends of arms 32, 34 are separated by a gap 38. This gap 38 is smaller than the diameter of the post 40. Both the clip 20 and the post 40 are typically formed out of a polymeric material such as HIPS, ABS, PC or nylon.

As shown in FIG. 1B, a plurality of clips 20 are connected to the rear side 54 of a false front panel 50. In a complimentary manner, a plurality of the posts 40 are connected to the side surfaces 62', 63' of the walls 62, 63 that define part of an opening 66 in an object 60. The false front panel 50 is used to cover this opening 66 in the object 60. As shown in FIG. 1B, typically, four separate false front connectors 10 are used to connect the false front panel 50 over the opening 66 in the object 60. As shown in FIG. 1B, the false front connectors may be arranged so that the posts 40 are attached at the top and bottom of the side surfaces 62', 63' of the walls 62, 63 that define the side of the opening 66 with the clips 20 similarly arranged adjacent the top and bottom of each side of the back surface 54 of the false front panel 50. The false front connectors 10 may be arranged so that a clip 20 is provided at the center of the top, bottom and side edges of the rear side 54 of false front panel 50, and so that the posts 40 are inserted at the corresponding locations at the center of side surfaces 65', 67', 62', 63' of the walls 65, 67, 62, 63 that define the opening 66. Other arrangements and/or numbers of the connectors 10 could also be used to attach the false front panel 50 over the opening 66.

As shown in FIG. 1B, when the false front panel 50 is placed over the opening 66 in the object 60, the clips 20 are aligned with the corresponding posts 40 which extend out into the opening 66. A force may then be applied to the front side 52 of the false front panel 50, which acts to enlarge the gap 38 between the arms 32, 34 on each clip 20 by forcing the arms 32, 34 to deflect away from each other. When the arms 32, 34 are sufficiently deflected, the posts 40 pass through the gap 38 in the corresponding clip 20. The arms 32, 34 then snap back into their original positions, thereby locking the posts 40 into their respective latches 30 on the clips 20. In this manner the false front panel 50 is attached over the opening 66. The false front panel 50 may later be removed by pulling on the front side 52 of the false front panel 50 with sufficient force to separate the posts 40 from their respective latches 30.

FIG. 2A depicts another known false front connector 70. The false front connector 70 likewise is a two piece connector that includes a clip 80 and a post 100. The post 100 is cylindrical in shape, and includes an aperture 102 along its central axis 104 having a diameter that is smaller than the head of the screw or nail, but large enough to receive the shank end of the screw/nail. In this manner, a screw or nail may be inserted through the aperture 102 into an object to connect the post 100 to the object.

The clip 80 has a base 82 and a pair of arms 92, 94 that extend substantially perpendicular from the base 82. The base 82 includes an aperture 84 that is configured to receive a screw (not shown in FIG. 2A). The diameter of the aperture 84 is smaller than the head of the screw, but large enough to receive the shank end of the screw so that the screw may be inserted through the aperture 84 into a false front panel to connect the clip 80 to the false front panel. The arms 92, 94 extend from respective sides of the base 82, and are configured to receive the post 100. The inner sides of arms 92, 94 are curved so that they together form opposing sides of an incomplete cylinder that has a diameter slightly larger than the diameter of the post 100. The distal ends of arms 92, 94 are separated by a gap 98. This gap 98 is smaller than the diameter of the post 100. The clip 80 is formed of a flexible metal such as aluminum and the post 100 is formed out of thermoplastic, HIPS, ABS, nylon, PC, HPPE or PP. As shown in FIG. 2B, false front connector 70 may be used in a fashion identical to false front connector 10 to connect a false front panel 50 over an opening 66 in an object 60.

Yet another known type of false front connector device 110 is depicted in FIG. 3A. As shown in FIG. 3A, the false front connector 110 is a one piece connector that has a base portion 120 and three fingers 130, 140, 150 which extend at a right angle from one edge of the base portion 120. The base portion 120 is thin and flat, and the front side 122 of the base portion 120 (the side opposite the rear side 124 from which the fingers 130, 140, 150 extend) may be glued or stapled to the rear side of a false front panel.

The fingers 130, 140, 150 of the false front connector 110 have respective flat strips 132, 142, 152 which extend at a 90 degree angle from one edge of the rear side 124 of the base portion 120. Each flat strip 132, 142, 152 includes at its distal end an abutment 134, 144, 154 that extends from the side of the strip 132, 142, 152 opposite the base portion 120. The abutments 134, 144, 154 have a cross section in the shape of a right triangle, and are somewhat thicker than either the flat strips 132, 142, 152 or the base portion 120. Each of the abutments 134, 144, 154 extends from the flat strips 132, 142, 152 such that one short side of its right triangle cross section attaches to its respective flat strip 132, 142, 152, and the other short side of the right triangle extends at a right angle from the respective flat strip 132, 142, 152 in a plane that is parallel to the plane of the base portion 120. As shown in FIG. 3A, the abutments 134, 144, 154 are sized differently, such that they extend different distances up the flat strips 132, 142, 152 towards the base portion 120. The connector 110 is formed out of ABS, PC or nylon.

As shown in FIGS. 3A and 3B, the front side 122 of the base portion 120 is connected to the rear side 54 of a false front panel 50. A connector 110 may be provided at the center edge of the top, bottom and sides of the rear side 54 of the false front panel 50 as illustrated in FIG. 3B, and are located such that the fingers 130, 140, 150 of each connector 110 will fit just within the respective top, bottom and sides of the opening 66. When the false front panel 50 is placed over the opening 66 in the object 60, the long side of each of the abutments 134, 144, 154, which are angled with respect to the walls 62, 63, 65, 67 that define the opening 66, engage the edges of the respective walls 62, 63, 65, 67. When a force is applied to the front surfaces 52 of the false front panel 50, this results in a force being applied by the walls 62, 63, 65, 67 on the abutments 134, 144, 154 of the particular connector 110 adjacent each respective wall. The force on the abutments 134, 144, 154 causes the fingers 130, 140, 150 to deflect in a direction away from the respective wall 62, 63, 65, 67, such that the abutments 134, 144, 154 on each connector 110 pass through the side surfaces 62', 63', 65', 67' of the walls 62, 63, 65, 67 that define the opening 66. Once the abutments 134, 144, 154 on each connector 110 have cleared the side surfaces 62', 63', 65', 67' of the walls 62, 63, 65, 67, the force on the abutments 134, 144, 154 is released, and the fingers 130, 140, 150 on each connector spring back into their normal position. When this occurs, the abutments 134, 144, 154 on each connector 110 are positioned behind and engage the rear surface 62", 63", 65", 67" of the respective walls 62, 63, 65, 67, locking the false front panel 50 into place over the opening 66.

Preferably, a false front connector will be inexpensive, easy to use, and provide a secure connection. Many prior art connectors, however, are not particularly easy to use and/or do not provide a secure connection. Accordingly, there is a need for improved false front connectors.

SUMMARY OF THE INVENTION

Connectors are provided that may be used to attach a false front panel over an opening in an object. Cabinets employing these connectors are also provided. The false front connectors according to embodiments of the present invention may be used with false front panels that are to be both permanently joined or releasably attached over the opening in the object. In certain embodiments of the present invention, the false front connectors comprise a body portion that is configured to abut and attach to a rear surface of the false front panel, and first and second snap clips that extend from the body portion and which are configured to engage opposing walls that partially define the opening in the object. These connectors may further include a third snap clip that extends from the body portion and that is configured to engage a third of the walls that defines the opening. These connectors may also include a spacer which extends from and parallel to the body portion.

In embodiments of the present invention, the snap clips which comprise part of the false front connectors have an extending member that extends from the body portion of the connector. An engaging projection may be provided that extends from the distal end of the extending member, and this engaging projection may be configured to engage one of the walls that define the opening in the object. The surface of the engaging projection which is configured to engage the wall may be beveled relative to the rear surface of the wall. This angling of the engaging surface of the engaging projection with respect to the surface of the wall it is configured to engage allows a single connector to be used for openings of varying thickness, and also may improve the releasability of the false front panel. In embodiments of the present invention, the engaging projection meets the rear surface of the wall it engages at an angle between 20 and 70 degrees.

In other embodiments of the present invention, false front connectors are provided that comprise an elongate body portion having a length that is approximately the width of the opening in the object that is to be covered by the false front panel. These connectors include first and second snap clips that extend from opposing ends of the body portion and which are configured to engage opposing of the walls that partially define the opening. These connectors may optionally include a third snap clip that extends from the body portion that is configured to engage a third of the walls that define the opening.

Methods of using false front connectors to attach a false front panel over an opening in an object are also provided.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. The dimensions of some components may be exaggerated for clarity.

Figure 4:
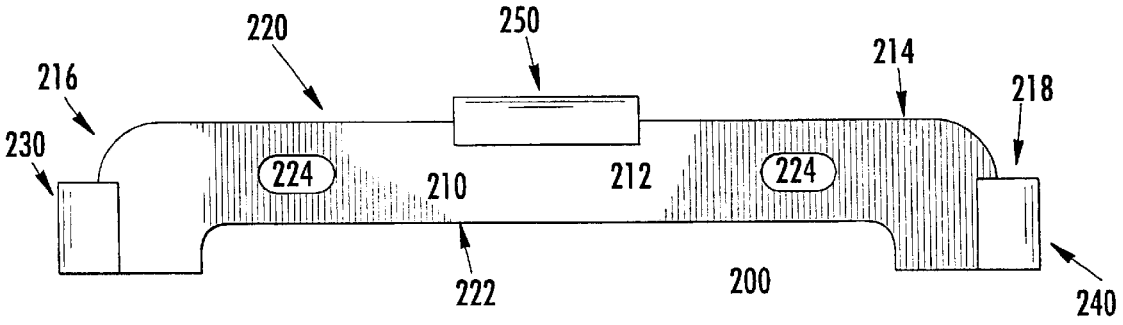
FIG. 4 is a front plan view of a false front connector according to embodiments of the present invention.

The discussion herein relates to false front connectors that may be used to attach a false front panel over an opening in an object such as a cabinet. FIG. 4 depicts one embodiment of a connector 200 made according to the teachings of the present invention. As illustrated in FIG. 4, the connector 200 comprises a body portion 210 and a plurality of snap clips 230, 240, 250 which extend from the body portion 210. In the embodiment depicted in FIG. 4, the body portion 210 is relatively thin and flat, and has a front surface 212 and a rear surface 214. The body portion 210 typically is elongate, having a top end 216, a bottom end 218 and two sides 220, 222. It will be appreciated, however, that the body portion 210 may have a wide variety of configurations, and that it need not be, for example, elongate, rectangular in shape, thin or flat.

The body portion 210 also may include one or more apertures 224 that are configured to receive a fastener such as a screw or a nail (not shown in FIG. 4). In the embodiment depicted in FIG. 4 these apertures 224 comprise a slot, but those of skill in the art will appreciate that a wide variety of aperture shapes may be employed depending upon the type of fastener used. As discussed in more detail herein, the use of a slot shaped aperture 224 as opposed to a circular aperture may facilitate properly aligning the connector 200 on the rear side 54 of a false front panel 50. The shank end of a screw or nail may be inserted through such an aperture 224 from the front surface 212 to the rear surface 214 of the body portion 210 to fasten connector 200 to the rear face of a false front panel (not shown in FIG. 4). It will also be appreciated that any of a wide variety of connection means may be used to fasten connector 200 to the false front panel, including, for example, glue or other adhesives and/or staples or rivets that may or may not require apertures such as the apertures 224 depicted in FIG. 4. It will also be appreciated that the shape and thickness of the components of connector 200 may be varied from what is depicted in FIG. 4.

The connector 200 also includes a plurality of snap clips 230, 240, 250 that extend from the body portion 210. As used herein, the term "snap clip" refers to a spring clip that is designed to deflect when pushed through an opening and then spring back toward its original position after the distal end of the clip passes through the opening to engage the rear surface of at least one of the walls that define the opening.

Figure 5:
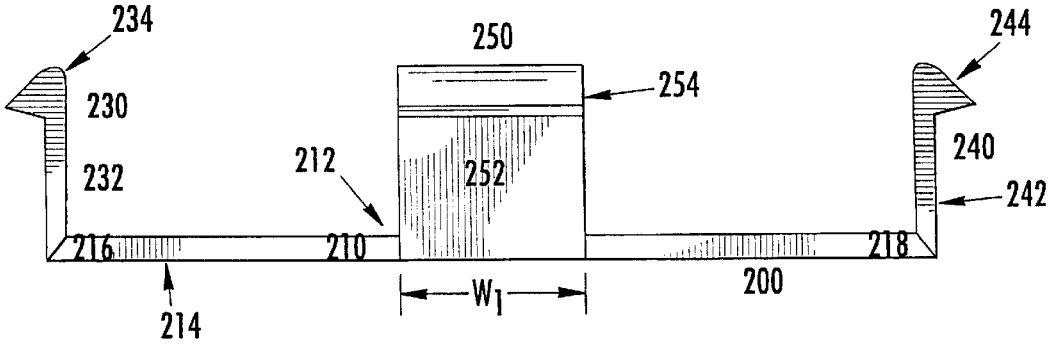
FIG. 5 is a side elevational view of the false front connector depicted in FIG. 4.

FIG. 5 is a side elevational view of the connector 200 depicted in FIG. 4. As illustrated in FIG. 5, the snap clips 230, 240, 250 used in the embodiment of the present invention depicted in FIG. 5 each comprise an extending member 232, 242, 252 and an engaging projection 234, 244, 254. The extending members 232, 242, 252 extend from and are normal to the front surface 212 of body portion 210. In the embodiment of FIG. 5, the extending member 232 projects from the top end 216 of body portion 210, the extending member 242 projects from the bottom end 218 of body portion 210, and the extending member 252 projects from the side 220 of body portion 210. As seen in FIGS. 4 and 5, the engaging projections 234, 244, 254 extend in a plane that is generally parallel to the plane of the body portion 210 and in a direction away from the body portion 210. It will be appreciated, however, that the engaging projections may be constructed in a wide variety of different shapes and sizes, and that they may likewise project from the extending members 232, 242, 252 at a variety of different angles.

Figure 9:
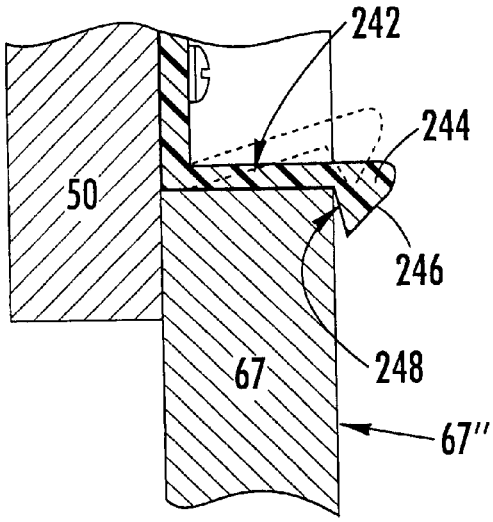
FIG. 9 is a partial cross-sectional view of one of the false front connectors of FIG. 7 taken along the line 9—9 in FIG. 7.

Engaging projection 244 will now be described in detail. As is apparent from FIGS. 4 and 5, the other two engaging projections 244, 254 are identical to engaging projection 244 in all respects except for orientation, and hence these engaging projections 244, 254 will not be discussed further. As is best seen in FIG. 9, the engaging projection 244 has a rear face 246 and an engaging face 248. The engaging face 248 is angled or "beveled" with respect to the plane of body portion 210. The rear face 246 is likewise angled with respect to the plane of body portion 210. This angling of the rear face 246 may facilitate insertion of the false front connector 200 into the opening as discussed below. The extending member 244 and the beveled face 248 are of a width $w_1$ (see FIG. 5 with respect to corresponding extending member 254 and beveled face 258). In a preferred embodiment of the present invention, the width $w_1$ of the beveled face 248 is between 0.4 and 4.0 millimeters, as extending members having an engaging face with this range of widths may provide a relatively snug fit, yet also provide for good releasability. However, it will be appreciated that other widths may be used, as the snugness of the fit and the connectors ability to release after installation depends on a variety of factors including, for example, the materials used to form the clips and the number of snap clips employed.

The ends of the extending members 232, 242, 252 adjacent the body portion 210 may be thinner than the ends of the extending members 232, 242, 252 adjacent the engaging projections 234, 244, 254. In such embodiments, the cross-sectional area of extending members 232, 242, 252 (i.e., the area of a plane taken through the extending member that is parallel to the plane defined by the rear surface 214 of the body portion 210) is greater at the distal ends of the extending members 232, 242, 252 than at the respective bases of the extending members 232, 242, 252. Such an arrangement may facilitate urging the extending members 232, 242, 252 to deflect at a point about their respective bases when a force is applied to the respective engaging projections 234, 244, 254.

Figure 6:
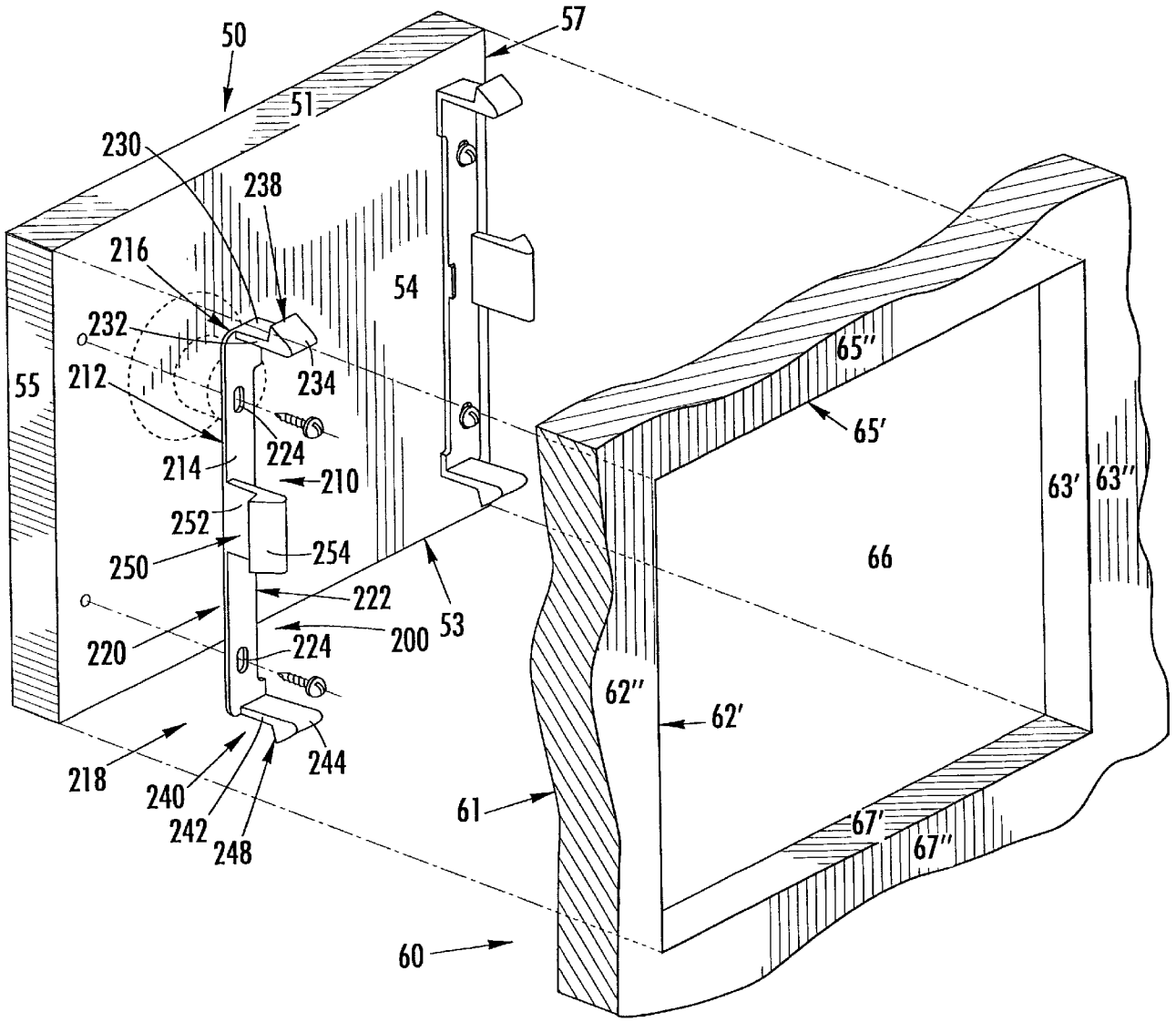
FIG. 6 is a perspective view of a pair of the false front connectors of FIG. 4 being used to connect a false front panel over an opening in an object.

FIG. 6 illustrates how a pair of the false front connectors 200 may be used to attach a false front panel 50 over an opening 66 in an object 60. The object 60 may be, for example, a bathroom cabinet having a false drawer front in front of the washbasin that covers an access hole to the inside of the cabinet. In FIG. 6, this access hole or opening 66 is defined by the walls 62, 63, 65, 67 which together form the front panel 61 of the object 60. The walls 62, 63, 65, 67 have a front surface (the exterior surface of panel 61), a side surface 62', 63', 65', 67' that defines the opening 66, and a rear surface 62", 63", 65", 67".

The false front panel 50 has a front surface 52 and a rear surface 54. In the example of FIG. 6, the false front panel 50 is shaped like a drawer front and has a top edge 51, a bottom edge 53 and two side edges 55, 57. As shown in FIG. 6, a false front connector 200 is attached adjacent each of the side edges 55, 57 of the rear surface 54. The rear surface 54 of the false front panel 50 may be placed over the opening 66 such that the connectors 200 pass through the opening 66. Preferably, the connectors 200 are located on the rear side 54 of false front panel 50 such that the engaging projections 234, 244, 254 on each connector 200 contact the front surface of the respective wall 62, 63, 65, 67 to which they are aligned when the false front panel 50 is placed in front of the opening 66. As the false front panel 50 is moved closer to the opening 66, the angled rear faces 236, 246, 256 of the engaging projections 234, 244, 254 contact the edge of the walls 62, 63, 65, 67 with which they are aligned, and deflect towards the center of the opening 66. This deflection causes the snap clips 230, 240, 250 on each connector 200 to deflect towards the center of the opening 66, allowing the connectors 200 to be inserted into the opening 66 until the rear surface 54 of the false front panel 50 contacts the front surface 61 (i.e., the front surface of walls 62, 63, 65, 67) of object 60. Notably, although in the embodiment of the present invention depicted in FIG. 6 the rear faces 236, 246, 256 of the engaging projections 234, 244, 254 are angled with respect to plane of body portion 210, they need not be angled for the connectors of the present invention to properly operate. It will likewise be appreciated that the number or the position of the connectors 200 may be modified from what is shown in FIG. 6. For instance, the connectors 200 may be disposed laterally adjacent the top edge 51 and the bottom edge 53 of the rear surface 54 of the false front panel 50 in lieu of or in addition to the connectors 200 shown adjacent the side edges 55, 57 of the rear surface 54.

Figure 7:
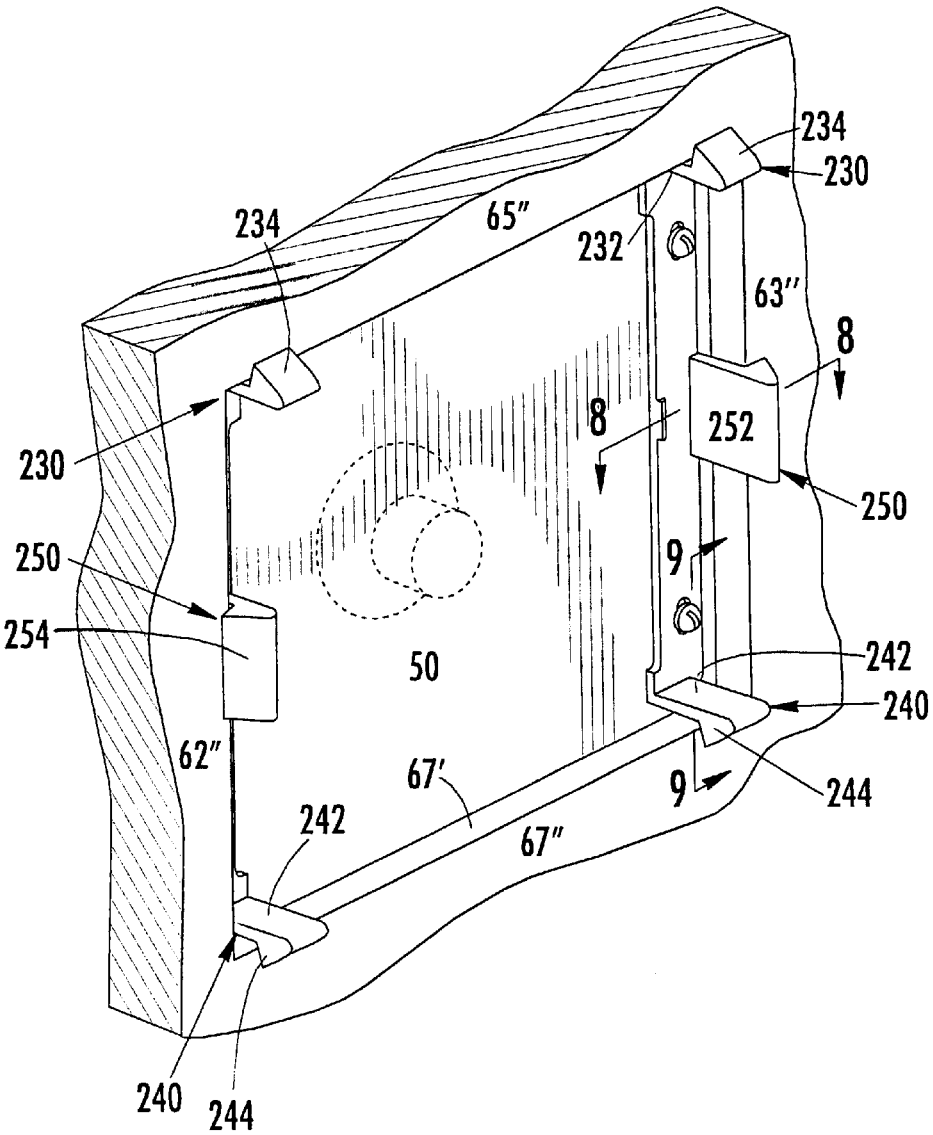
FIG. 7 is a perspective view of a pair of false front connectors of FIG. 4 being used to connect a false front panel over an opening in an object after the false front panel has been placed over the opening.

FIG. 7 depicts the false front panel 50 of FIG. 6 after it has been inserted into the opening 66 in the object 60. As is apparent from FIG. 7, the length of the extending member 232, 242, 252 on each snap clip 230, 240, 250 is approximately equal to the width of the side surfaces 62", 63", 65", 67" of the walls 62, 63, 65, 67, such that the engaging projections 234, 244, 254 on each snap clip 230, 240, 250 on the connectors 200 extend all the way through the opening 66. As shown in FIG. 7, after the engaging projections 234, 244, 254 pass through the opening 66, they deflect back towards their original position such that part of the engaging projections 234, 244, 254 reside outside the plane of the opening 66 and engage the rear surface 62", 63", 65", 67" (or at least the edge between the side surface 62', 63', 65', 67' and the rear surface 62", 63", 65", 67") of the walls 62, 63, 65, 67. In this manner, the false front panel 50 may be securely fastened over the opening 66.

Figure 8:
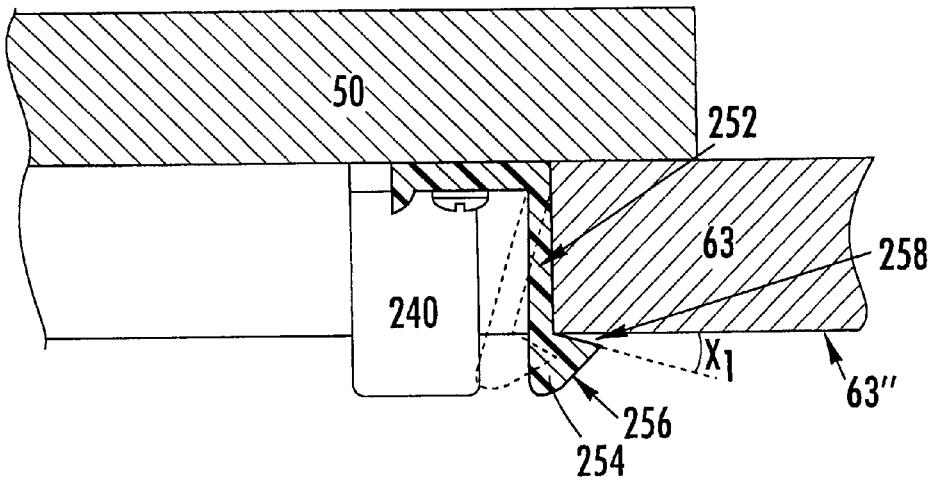
FIG. 8 is a partial cross-sectional view of one of the false front connectors of FIG. 7 taken along the line 8—8 in FIG. 7.

FIG. 8 is a partial cross-sectional view of snap clip 250 on the rightmost false front connector 200 of FIG. 7, which is taken along the line 8—8 in FIG. 7 that depicts the position of the center snap clip 250 with respect to the opening 66 after the false front panel 50 is installed over the opening 66. As shown in FIG. 8, the false front panel 50 is inserted into the opening 66 until its rear surface 54 comes into contact with the front panel 61 (i.e., the front surface of walls 62, 63, 65, 67) of the object 60. In this manner the false front connector 200 is fully inserted into (and partially beyond) the opening 66. The snap clip 250 abuts against the rear surface 63" of the wall 63. The extending member 252 of the snap clip 250 is approximately the width of the side surface 63' of the wall 63, and the engaging projection 254 extends out of the rear side of the opening 66. As shown in FIG. 8, the beveled engaging face 258 of engaging projection 254 primarily or solely contacts wall 63 at the interface of the side surface 63' and the rear surface 63". As a result, the rear surface 63" and the beveled engaging face 258 form an angle $x_1$ (see FIG. 8).

Figure 12:
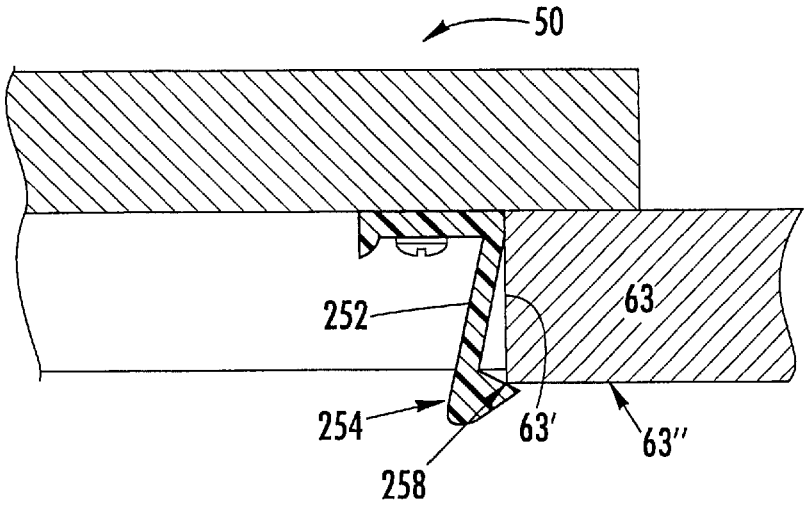
FIG. 12 is a partial cross-sectional view similar to FIG. 8 except that the side wall of the opening is thicker in FIG. 12.

While the false front connectors according to the present invention do not require a beveled engaging face such as the face 258 in FIG. 8, such an arrangement may be advantageous for at least two reasons. First, depending upon the application, the width of the side surface 63' of the wall 63 may vary. By providing a beveled engaging face (e.g., face 258) on the snap clip 250, such variation may be more readily accommodated. Specifically, as illustrated in FIG. 12, in a situation where the side surface 63' of the wall 63 is wider than the length of the extending member 252, the engaging projection 254 engages the edge between the side surface 63' and rear surface 63" of wall 63 at a mid-point of the engaging face 258, and the snap clip 250 remains partially deflected. However, as long as a sufficient portion of engaging projection 254 extends beyond the plane of side surface 63' adjacent the rear surface 63" of wall 63, the snap clip 250 will act to hold the false front panel 50 in place over the opening 66.

Additionally, the beveled nature of engaging face 258 may also facilitate removal of the false front face if and when such removal is necessary or desirable. In particular, by angling the engaging face 258, less force is required to deflect the snap clip 250 toward the opening 66, and it is possible to reduce the chance that the snap clips will be damaged or broken when the false front panel 50 is removed from the opening 66. In preferred embodiments of the present invention, the angle $x_1$ depicted in FIG. 8 is between 20 degrees and 70 degrees. However, it will be appreciated that the optimum angle may depend on a variety of factors, including, for example, the material from which the clip is formed, the weight of the false front panel, the number of snap clips employed and the desired snugness of the fit of the false front panel 50 over the opening 66.

In FIG. 8 the dashed representation of the snap clip 250 shows the position of the snap clip as it moves through the opening 66, where it is deflected towards the center of the opening 66. As the engaging projection 254 clears the side surface 63' of the wall 63, the snap clip 250 deflects back towards its original position such that it is substantially normal to the plane of body portion 210.

FIG. 9 is a partial cross-sectional view of snap clip 240 on the rightmost false front connector 200 of FIG. 7 which is taken along the line 9—9 in FIG. 7 that depicts the position of the snap clip 240 with respect to the opening 66 after the false front panel 50 is installed over the opening 66. As the snap clip 240 operates in the same manner as the snap clip 250 described above with respect to FIG. 8, except that it engages a different wall (wall 67), FIG. 9 will not be described further herein.

As is best shown in FIG. 7, the body portion 210 of the connector 200 may be sized so that the length of the connector 200 (i.e., the distance separating snap clip 230 and the snap clip 240) is approximately the same as the length of side surfaces 62', 63' of the opening 66. In this manner, the extending members 232, 242 of the snap clips 230, 240 will fit just within the side surfaces 65', 67' of the walls 65, 67 defining the top and bottom of opening 66 when the false front panel 50 is placed over the opening 66.

Figure 1A:
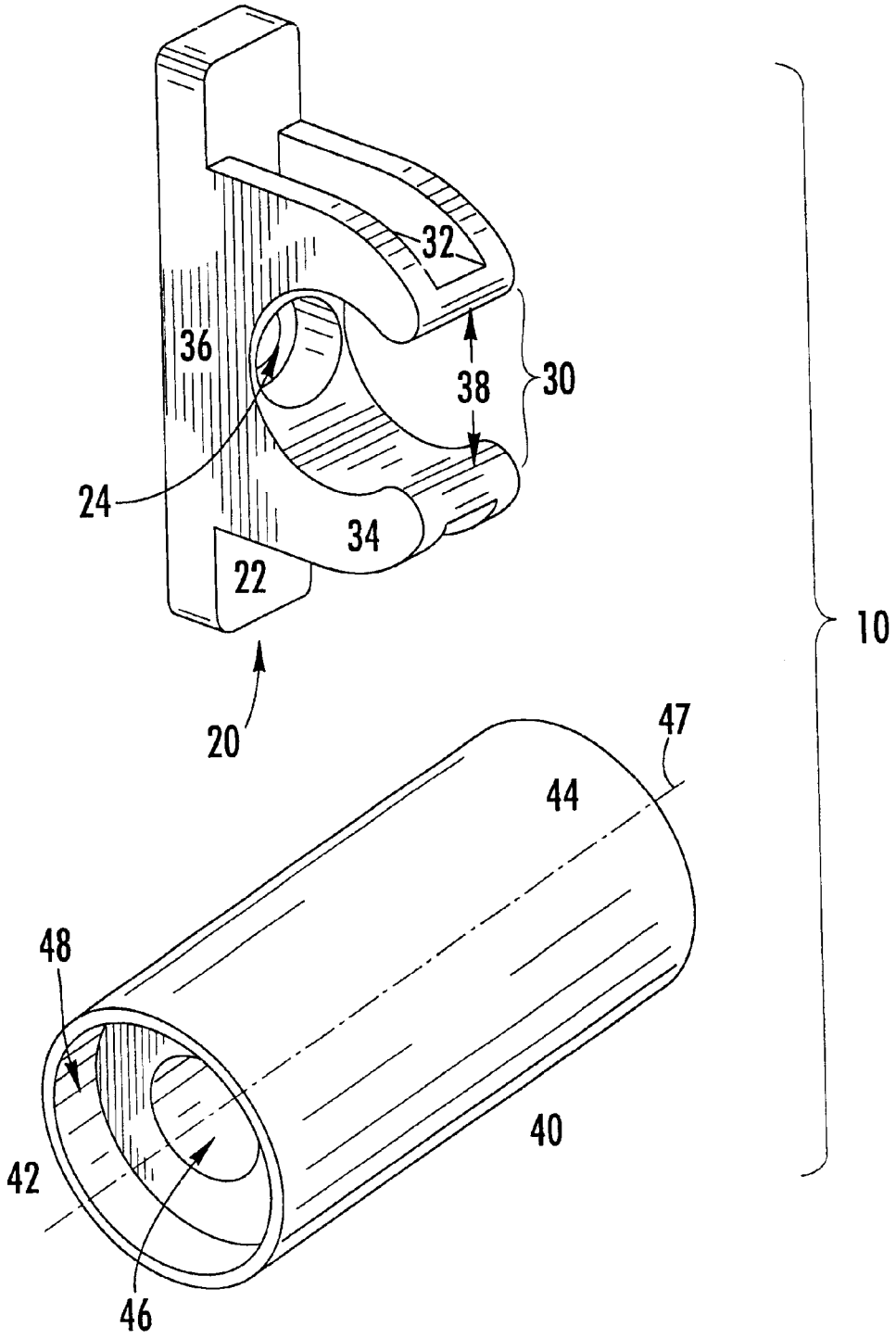
FIGURE 1A. (PRIOR ART)
FIG. 1A is an exploded view of a prior art false front connector.
Figure 1B:
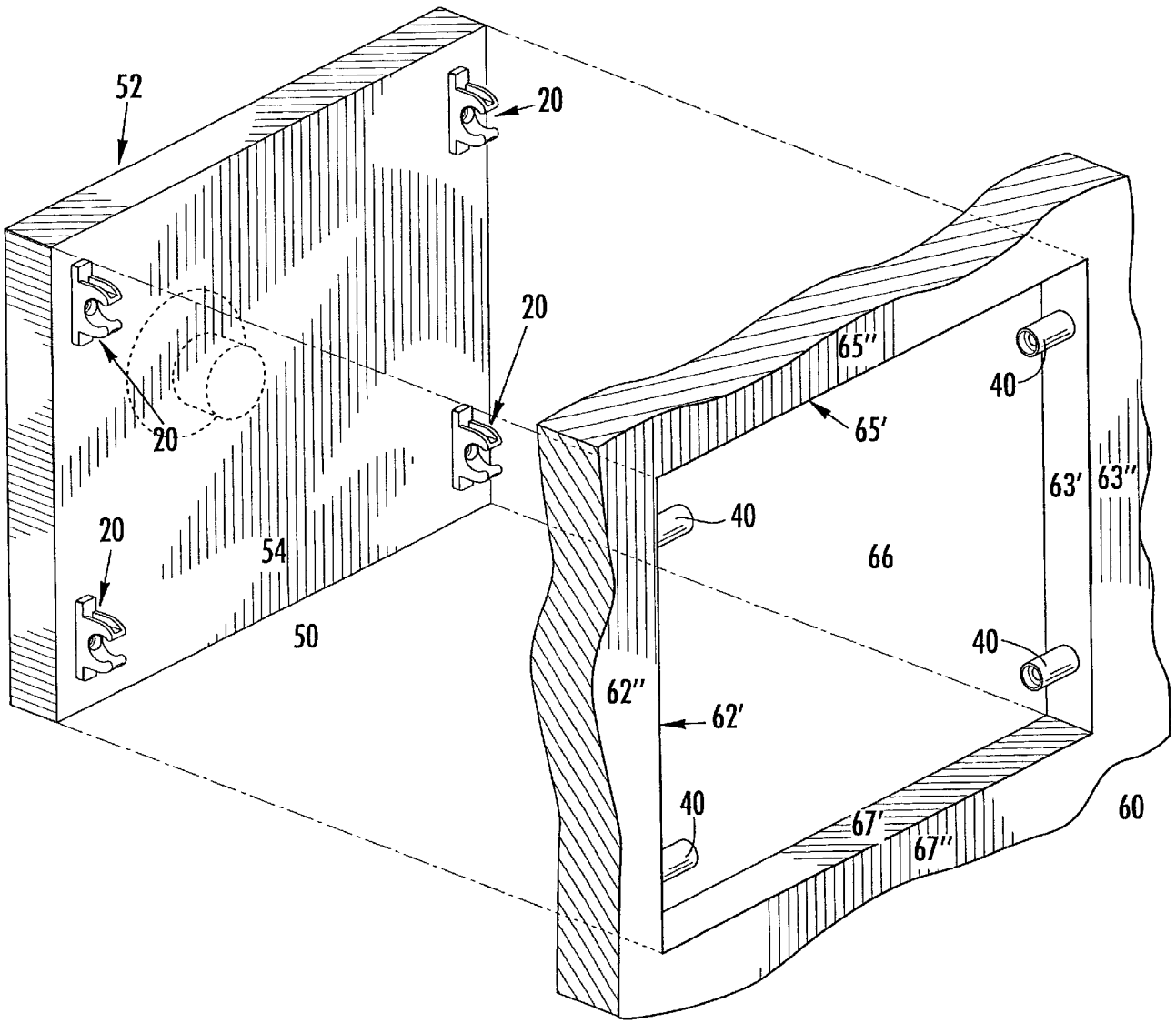
FIGURE 1B. (PRIOR ART)
FIG. 1B is an exploded view of four of the false front connectors of FIG. 1A being used to connect a false front panel over an opening in an object.
Figure 2A:
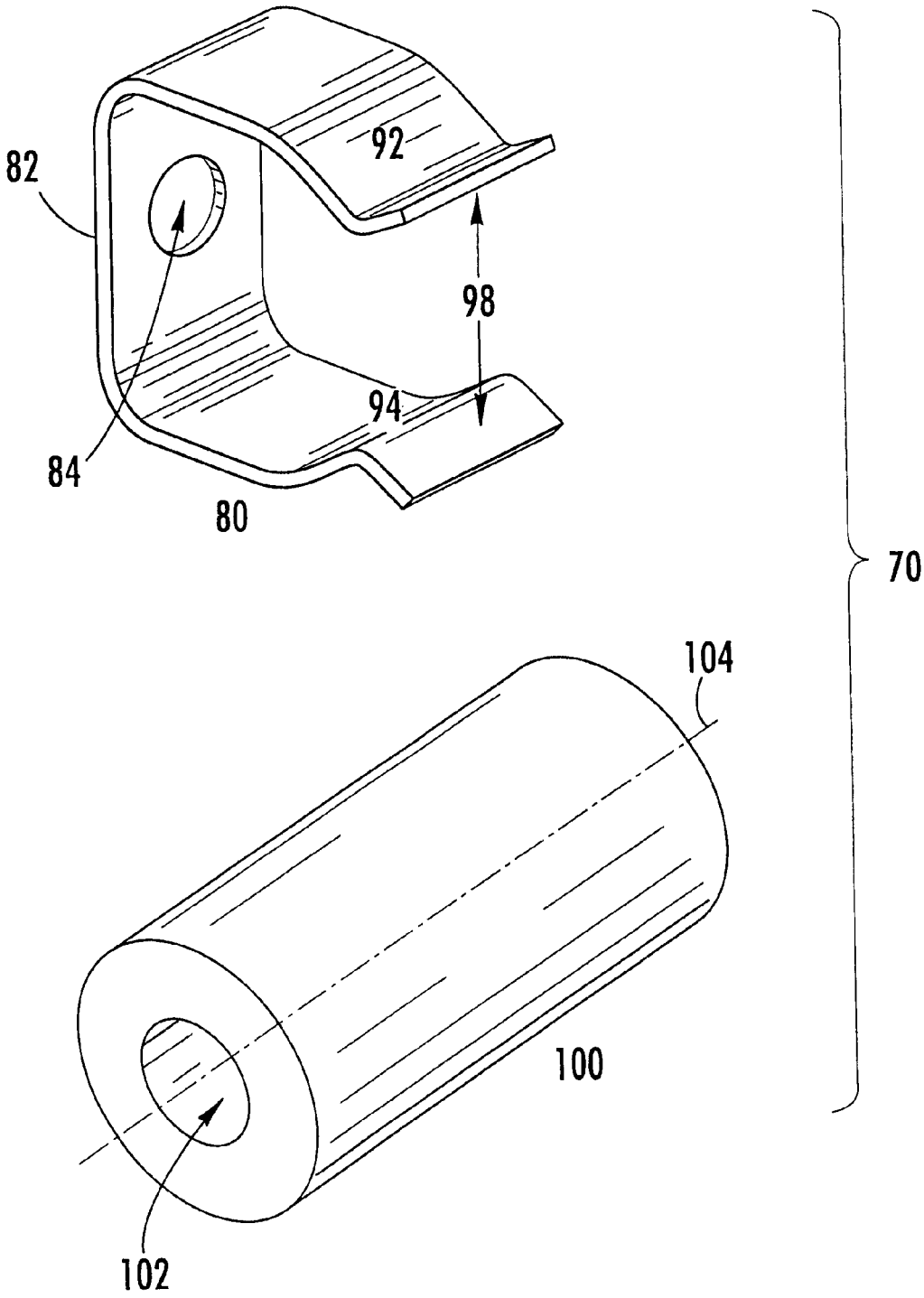
FIGURE 2A. (PRIOR ART)
FIG. 2A is an exploded view of another prior art false front connector.
Figure 2B:
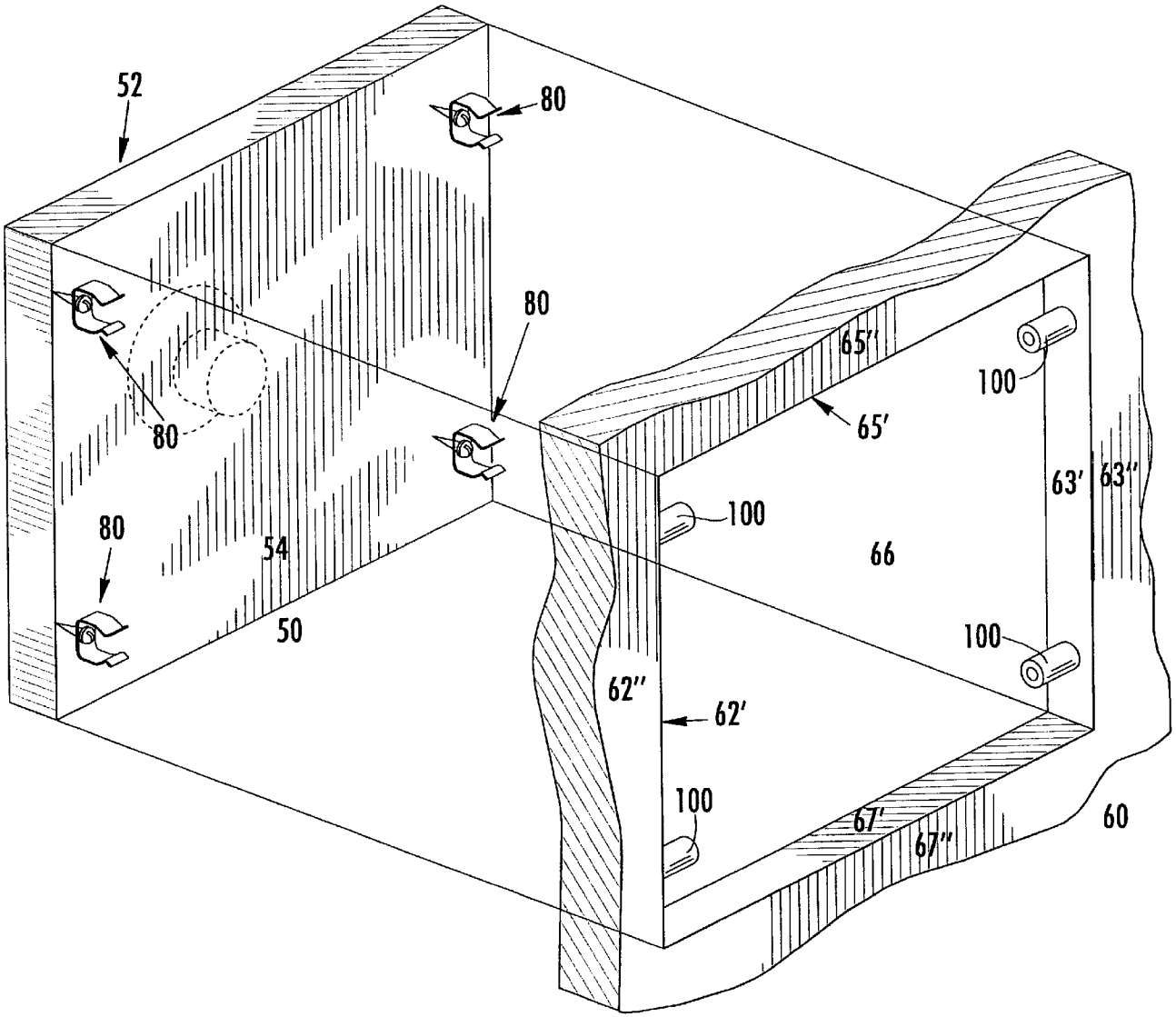
FIGURE 2B. (PRIOR ART)
FIG. 2B is an exploded view of four of the false front connectors of FIG. 2A being used to connect a false front panel over an opening in an object.
Figure 3A:
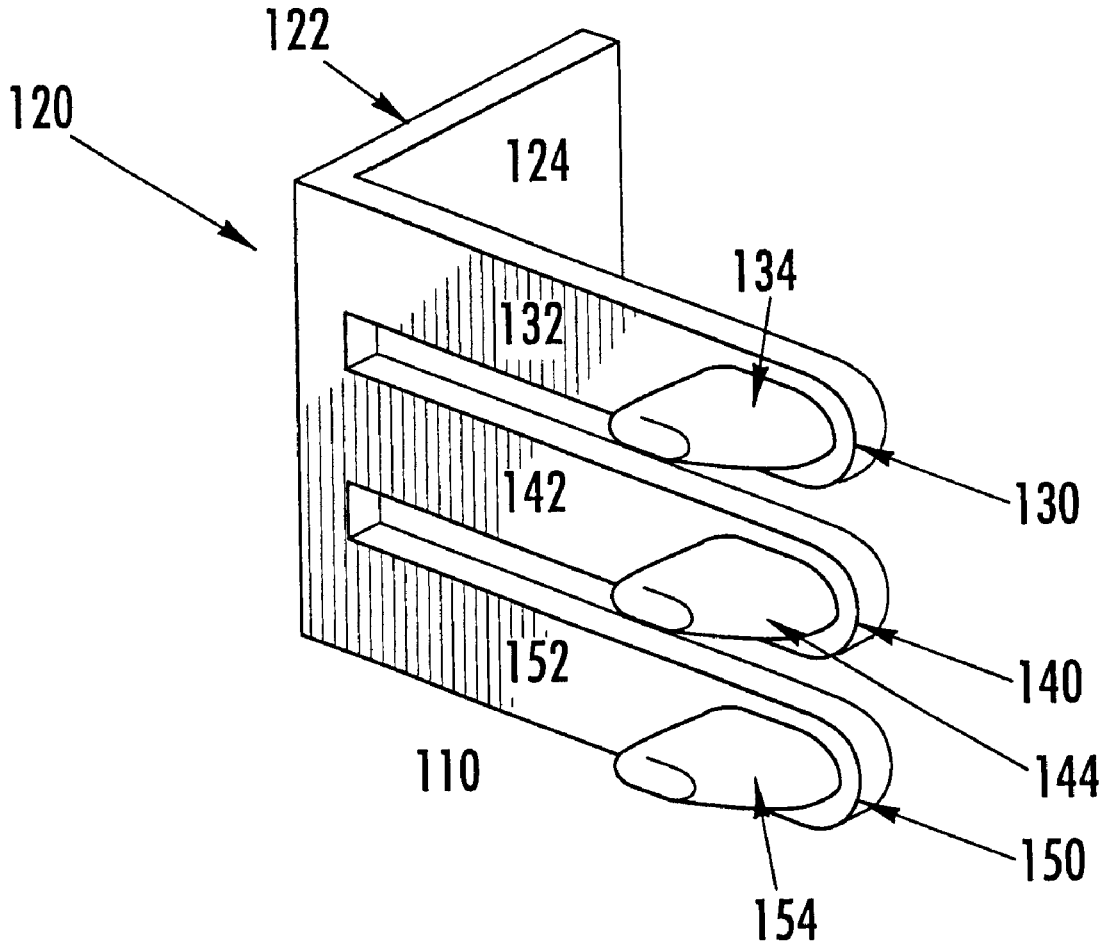
FIGURE 3A. (PRIOR ART)
FIG. 3A is a perspective view of another prior art false front connector.
Figure 3B:
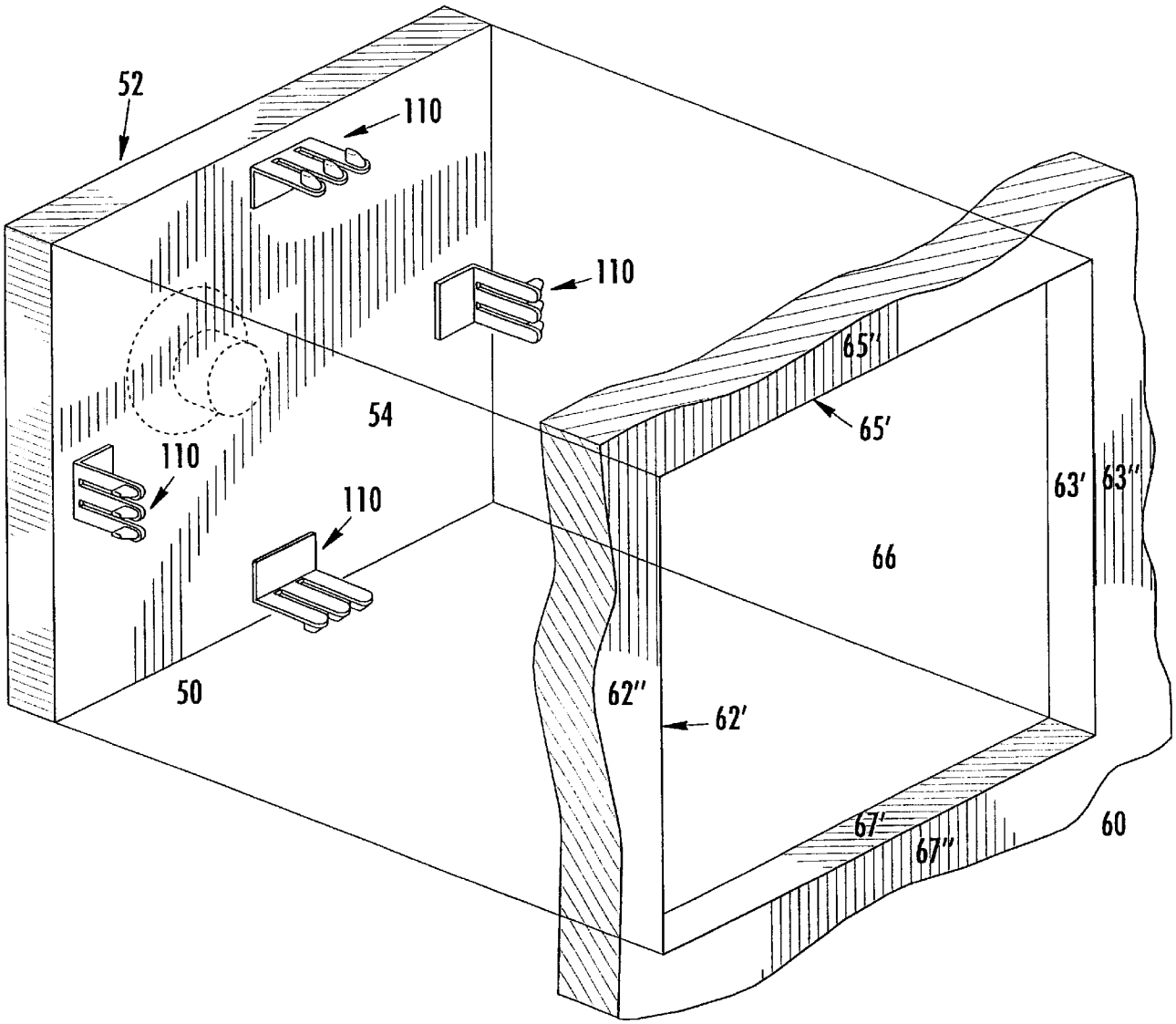
FIGURE 3B. (PRIOR ART)
FIG. 3B is an exploded view of four of the false front connectors of FIG. 3A being used to connect a false front panel over an opening in an object.

The false front connectors of the present invention may be easier to align than the conventional connectors depicted in FIGS. 1–3 for several reasons. Simplification of the alignment process can result in substantial labor savings in the installation of false front panels, and may also facilitate providing false front panels that are properly installed so as to provide both a snug fit and so as to be readily releasable, if desired. One manner in which the false front connectors of the present invention may serve to simplify the alignment process is by providing a plurality (i.e., at least two) snap clips per connector. This allows one alignment process to serve to align multiple clips, thus typically reducing the overall number of alignments which need to be performed. Additionally, the connectors of the present invention can be implemented as one piece false front connectors in contrast to the conventional two piece connectors depicted in FIGS. 1–2. The use of such two piece connectors may complicate the alignment process, as two separate pieces must be installed on two separate mounting surfaces so as to mate when the mounting surfaces are placed in their proper position.

Additionally, as noted above, in embodiments of the present invention the body portion 210 of the false front connector 200 extends the full width of the opening. Since in many applications the false front panel should be mounted over the opening 66 such that it extends for equal distances above and below the opening, the longitudinal position of the connector 200 may be determined by simply placing the connector so that the top end 216 of the connector 200 is the same distance from the top 51 of the false front panel 50 as the bottom end 218 of the connector 200 is from the bottom edge 53 of the false front panel 50.

Furthermore, as best illustrated in FIG. 6, the connectors 200 may be attached to the rear surface 54 of the false front panel 50 by screws that are placed through slotted apertures 224 in the body portion 210 of the connector 200. This use of slotted apertures 224 allows the placement of the connector to be readily adjusted (by loosening but not removing the screw and moving the connector along the axis of the slot) if the initial fit of the false front panel 50 over the opening 66 is sub-optimal. The slotted apertures 224 may be provided to facilitate adjustment in either the up-down or side-to-side direction.

The false front connectors of the present invention may also advantageously provide for superior attachment as compared to the conventional false front connectors described above. By way of example, the snap clips 230, 240, 250 on the false front connector 200 have engaging portions 234, 244, 254 which are substantially wider than the abutments provided on the conventional connector depicted in FIG. 3. By allowing the engaging portions 234, 244, 254 on the snap clips 230, 240, 250 to engage a larger portion of the walls 62, 63, 65, 67 that define the opening 66, a snugger, more secure fit of the false front panel 50 over the opening 66 may be achieved.

Figure 10:
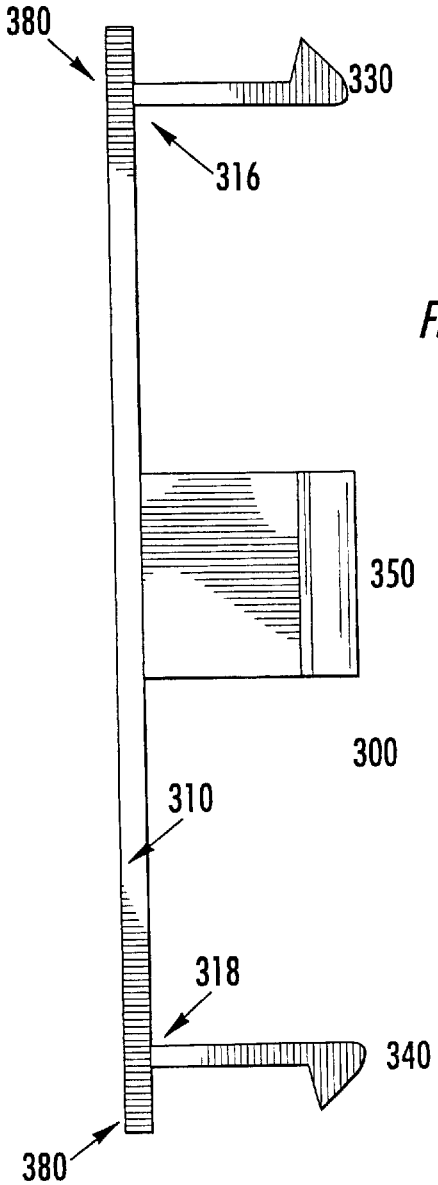
FIG. 10 is a side elevational view of an alternative false front connector of the present invention that includes a spacer.

FIG. 10 illustrates a connector 300 which is an alternative embodiment of the present invention. The connector 300 is substantially the same as the connector 200 described above with respect to FIGS. 4–9, except that connector 300 includes a spacer 380. This spacer may serve to provide a small separation between the false front panel 50 and the front surface 61 of the object 60 to which it is attached. Such a separation may be desired, particularly in instances when the false front panel 50 is designed to appear like a drawer face, because it may make the false front panel 50 look more realistic.

As shown in FIG. 10, the spacer 380 may comprise an extension of the body portion 310 of the connector 300 so that it will extend outside of the footprint of the opening 66 when the false front panel 50 is placed in its proper position over the opening 66. The spacer 380 may be conveniently provided by extending either or both of the top end 316 or the bottom end 318 of the body portion 310 beyond the location where the respective top snap clip 330 and/or bottom snap clip 340 extend from the body portion 310.

Figure 11:
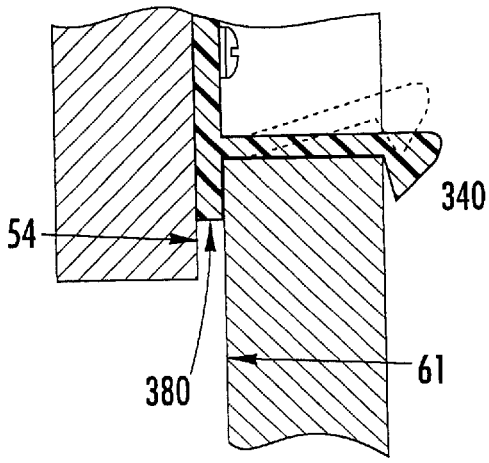
FIG. 11 is a partial cross-sectional view of the connector of FIG. 10 which depicts the connector in use holding a false front panel over an opening.

As shown in FIG. 11, when the connector 300 of FIG. 10 is used to attach a false front panel 50 over an opening 66, the spacer 380 is sandwiched between the rear surface 54 of the false front panel 50 and the front surface 61 of the object 60 to which the false front panel 50 is being attached. In this manner, the spacer 380 acts to connect the false front panel 50 to the object 60 so that the false front panel 50 does not physically contact the object 60. It will be appreciated that spacer 380 may be implemented in a wide variety of different ways. By way of example, spacer 380 could be implemented by forming a strip of material on the rear surface 214 of the connector 200 that extends beyond body portion 210 in a direction away from the opening 66.

It will be appreciated that the connector 200 may be modified in a variety of ways without departing from the scope and teachings of the present invention. For instance, the connector 200 may be configured to have more or fewer snap clips than the three snap clips 230, 240, 250 illustrated in FIGS. 4–6. By way of example, the snap clip 240 may be omitted from the left most connector 200 in FIG. 6, and the snap clip 230 may be omitted from the right most connector 200. Similarly, in certain applications the central snap clip 250 may be removed from each of the connectors 200 in FIG. 6. In other applications, a second snap clip may be provided adjacent snap clip 250, and the snap clips 230, 240 may or may not be retained.

Likewise, although in the embodiment of connector 200 depicted in FIGS. 4–9 the snap clips 230, 240, 250 are perpendicular to body portion 210, it will be appreciated that the snap clips 230, 240, 250 can extend from the body portion 210 at other angles. By way of example, in certain embodiments of the present invention, it may be advantageous to have some or all of the snap clips 230, 240, 250 form an obtuse angle with the body portion 210. Such an arrangement may allow the connector 200 to assert a spring-like force on the side surfaces 62', 63' of the opening 66 to provide a more secure fit. It will also be understood that depending upon the length of the engaging portions 234, 244, 254, the snap clips 230, 240, 250 may meet the body portion 210 at an angle of less than 90 degrees. Accordingly, it will be understood that the connector depicted in FIGS. 4–9 is exemplary, and that features thereof not recited in the claims appended hereto are not intended to limit the scope of those claims.

In preferred embodiments of the present invention, the false front connectors such as connectors 200, 300 are manufactured out of a thermoplastic material such as polystyrene or ABS. However, those of skill in the art will appreciate that the connectors 200, 300 may be formed out of a wide variety of different materials, including any number of metals, synthetic compounds or the like. Typically, these connectors 200, 300 are injection molded from polymeric materials. As methods of manufacturing such connectors via conventional molding techniques are well known to those of skill in the art, the methods for manufacturing these connectors will not be discussed further herein.

As noted above, a variety of fasteners or other attachment means may be used to fasten the connectors disclosed herein to the false front panel 50, including, for example, screws, nails, staples, tacks or rivets. Herein, the connectors of the present invention are described as abutting and/or attaching to the rear surface of a false front panel. It will be appreciated that such language is intended to cover situations where the connector is directly attached to the false front panel, as well as situations where it is connected via intervening structures.

Figure 13:
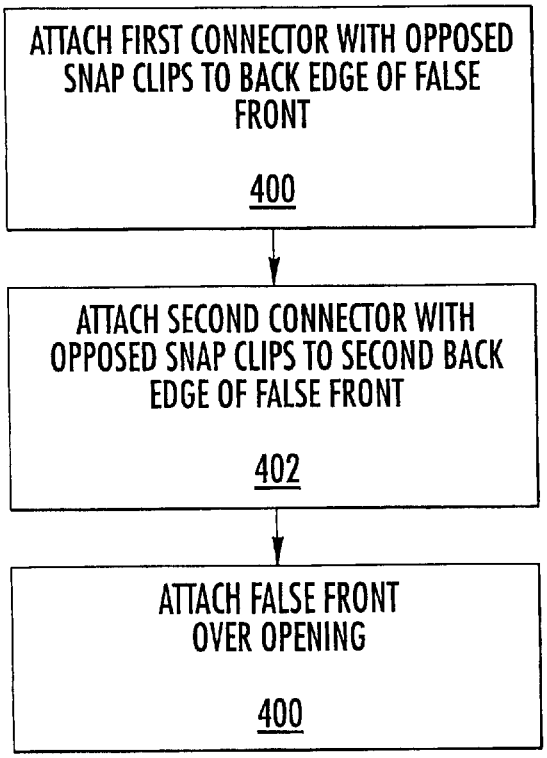
FIG. 13 is a flow chart depicting methods of using the false front connectors according to the present invention.

FIG. 13 is a flowchart diagram that describes aspects of methods of the present invention. As shown is FIG. 13, pursuant to these methods a false front panel may be placed over an object by attaching a first front connector that has opposed first and second snap clips adjacent a first edge on the rear surface of the false front panel (block 400). A second false front connector having first and second opposed snap clips may likewise be attached adjacent a second edge on the rear surface of the false front panel (block 402). The false front panel may then be attached over an opening in an object by placing the false front panel over the opening such that the first and second false front connectors extend through the opening to engage the rear surface of the walls which define the opening (block 404).

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A cabinet, comprising:

a frame having a front face, wherein said front face includes an opening defined by a plurality of walls;

a false front panel having a front side and a rear side; and at least one false front connector that includes:

a body portion fixed to and configured to abut the rear side of said false front panel;

a first snap clip extending from said body portion and configured to engage a first of the walls defining said opening; and a second snap clip extending from said body portion and configured to engage a second of the walls defining said opening, wherein said second wall is different from said first wall;

wherein the rear side of the false front panel is positioned adjacent the front face of the frame.

2. The cabinet of claim 1, wherein said first wall is opposite said second wall.

3. The cabinet of claim 2, wherein said false front connector further comprises a third snap clip extending from said body portion and configured to engage a third of the walls defining said opening.

4. The cabinet of claim 3, wherein said first wall is opposite said second wall, and wherein said third wall is substantially perpendicular to said first and second walls.

5. The cabinet of claim 2, further comprising a drawer adjacent said false front.

6. A false front connector that connects a false front panel over an opening in an object defined by a plurality of walls, comprising:

a body portion that abuts and attaches to a rear side of said false front panel;

a first snap clip extending from said body portion that engages a first of the walls defining said opening;

a second snap clip extending from said body portion that engages a second of the walls defining said opening, wherein said second wall is different from said first wall; and a third snap clip extending from said body portion that engages a third of the walls defining said opening.

7. The false front connector of claim 6, wherein said first wall is opposite said second wall.

8. The false front connector of claim 6, wherein said first wall is opposite said second wall, and wherein said third wall is substantially perpendicular to said first and second walls.

9. The false front connector of claim 6, further comprising a spacer extending from and parallel to the body portion.

10. The false front connector of claim 6, wherein said first and second snap clips each comprise an extending member that extends from said body portion, and an engaging projection extending from a distal end of said extending member that engages a rear surface of one of the walls that define said opening.

11. The false front connector of claim 10, wherein the cross-sectional area of extending members on said first and second snap clips is greater at the distal end of the extending members than at the base of the extending members.

12. The false front connector of claim 10, wherein a face of said engaging projection that engages the rear surface of said wall is beveled relative to the rear surface of said wall.

13. The false front connector of claim 12, wherein said face of said engaging projection engages said rear surface of said wall at an angle between 20 and 70 degrees.

14. The false front connector of claim 6, wherein said body portion further comprises first and second slots that receive first and second fasteners which connect said false front clip to the rear of said false front panel and enable said body portion to be adjusted relative to said false front panel.

15. A false front connector for connecting a false front panel over an opening in an object defined by at least first, second and third walls, said second and third walls opposing one another, comprising:

an elongate body portion having a length that is substantially the same length as said first wall, wherein said body portion is-configured to attach to a rear side of said false front panel;

a first snap clip extending from said body portion that is configured to engage said second wall;

a second snap clip extending from said body portion that is configured to engage said third wall; and a third snap clip extending from said body portion that is configured to engage said first wall.

16. The false front connector of claim 15, wherein said first snap clip extends rearwardly from and normal to a first end of said body portion, and wherein said second snap clip extends rearwardly from and normal to a second end of said body portion.

17. The false front connector of claim 15, further comprising a spacer extending from at least one end of the elongate body portion.

18. The false front connector of claim 15, wherein said first and second snap clips each comprise an extending member that extends from said body portion, and an engaging projection extending from the distal end of said extending member and configured to engage one of the walls that define said opening.

19. The false front connector of claim 18, wherein a face of said tab that is configured to engage said wall is a beveled face.

20. The false front connector of claim 18, wherein the end of the extending members on said first and second snap clips adjacent the body portion is thinner than the end of the extending members adjacent the engaging projection.

21. A method of connecting a false front panel over an opening in an object, the method comprising:

fixing a first false front connector having opposed first and second snap clips to the false front panel adjacent a first edge of the rear surface of said false front panel;

fixing a second false front connector having opposed first and second snap to the false front panel clips adjacent a second edge of the rear surface of said false front panel;

attaching the false front panel over the opening by placing the false front panel over the opening such that the first and second false front connectors extend through said opening to engage the rear surface of the walls which define the opening.

22. The method of claim 21, further comprising the act of simultaneously aligning the position of at least two snap clips with respect to the rear surface of the false front panel.

23. The method of claim 22, wherein the act of aligning comprises the act of locating one of the first or second false front connectors on the rear surface of the false front panel such that first and second ends of the false front connector are equidistant from the respective top and bottom edges of the rear surface of the false front panel.

* * * * *

UNITED STATES PATENT AND TRADEMARK OFFICE

CERTIFICATE OF CORRECTION

PATENT NO. : 6,557,956 B2
DATED : May 6, 2003
INVENTOR(S) : Robert C. Hightower

It is certified that error appears in the above-identified patent and that said Letters Patent is hereby corrected as shown below:

Title page,
Item [73], Assignee, please insert -- Tenn-Tex Plastics, Inc., Colfax, NC 27235 --.

Signed and Sealed this

Eleventh Day of November, 2003

JAMES E. ROGAN
*Director of the United States Patent and Trademark Office*